US005386174A

United States Patent [19]

Ishii

[11] Patent Number: 5,386,174

[45] Date of Patent: Jan. 31, 1995

[54] PANEL FOR COLOR CATHODE-RAY TUBE

[76] Inventor: Eiji Ishii, 1-4-307, Komone 1-chome, Itabashi-ku, Tokyo, Japan

[21] Appl. No.: 886,198

[22] Filed: May 21, 1992

[51] Int. Cl.[6] ..... H01J 29/86

[52] U.S. Cl. ..... 313/408; 313/477 R

[58] Field of Search ..... 313/408, 477 R

[56] References Cited

U.S. PATENT DOCUMENTS

| | | | |
|---|---|---|---|
| 4,537,322 | 8/1985 | Okada et al. | 313/477 R X |
| 4,570,101 | 2/1986 | Campbell | 313/477 R X |
| 4,943,754 | 7/1990 | Hirai et al. | 313/477 R |

*Primary Examiner*—Sandra L. O'Shea

*Attorney, Agent, or Firm*—Staas & Halsey

[57] ABSTRACT

Disclosed is a front panel capable of accommondating a shadow-mask high-quality color cathode-ray tube. By using the panel in combination with a shadow mask employing non-deforming steel having a small coefficient of expansion, a panel which is well-balanced and easy to view is obtained. The front panel consists of a transparent glass material and has an outer surface and an inner surface formed to be curved surfaces. The radius of curvature in one direction of the curved surface forming the outer surface of the front panel is greater than the radius of curvature in a direction perpendicular to the first-mentioned direction.

3 Claims, 6 Drawing Sheets

CONVEX CYLINDRICAL SHAPE

PLAN VIEW OF CONVEX CYLINDRICAL SHAPE

SECTIONAL VIEW OF PANEL

SECTIONAL VIEW OF PANEL

SPHERICAL

CYLINDRICAL

PANEL FOR COLOR CATHODE-RAY TUBE

BACKGROUND OF THE INVENTION

1. Field of the Invention

This invention relates to a color cathode-ray tube panel having a front surface which is easier to view and more balanced in comparison with the conventional shadow-mask cathode-ray tube.

2. Description of the Prior Art

A color television cathode-ray tube includes a funnel-shaped main body having a rectangular open side, and a cylindrical neck portion, which accommodates three electron guns for the colors R, G, B, connected to the bottom of the main body. Affixed to the open side of the main body is a front panel comprising a transparent glass plate. The inner and outer surfaces of the front panel are formed to be curved. A shadow mask is disposed on the rear side of the front panel.

The original form of the panel of the conventional shadow-mask color television cathode-ray tube utilizes any portion extracted from a sphere, as shown in FIG. 6(A). There are a wide variety of these models presently employed in small-size tubes. Though such models are employed to some extent in large-size tubes as well, the majority have a panel surface that is asopherical owing to problems related to the doming phenomenon, temperature drift and convergence in the deflection yoke, or because of the need for a rectangular, flat screen. In general, as illustrated in (A) and (B) of FIG. 2, the radius $R_{YO}$ of the panel surface in the vertical direction is smaller than the radius $R_{XO}$ in the horizontal direction, and there are portions of the surface which extend in directions from which a picture is difficult to view or in directions which cause an increase in distortion of the picture.

Another problem is that increasing the doming phenomenon and enlarging the radius $R_{YO}$ to obtain a panel surface that is easy to view are contractory to each other in terms of their effects.

According to the shadow-mask configuration, the basic shape of a panel of the Trinitron (registered trademark) type using a color selecting mechanism of different shapes (in which the color selecting mechanism employs an aperture grill) utilizes part of a cylindrical shape shown in FIG. 6(B). The radius $R_{YO}$ of FIG. 2(B) defines a shape approximating a straight line. With regard to viewing ease, it is obvious that this configuration is superior to that of the present shadow-mask panel in view of the fact that there is little reflected external light from above. Whether a panel of this form can be used or must be used is decided by the basic structure of the aperture grill.

In a case where the cylindrical configuration is adopted as the panel for the shadow mask, it is required that the radius $R_{YO}$ of the shadow mask have a form approximating a straight line, and it is difficult to maintain this shape with a high degree of accuracy. In addition, this is a direction involving inconvenience with regard to doming. The cylindrical panel is suited to the Trinitron (registered trademark) system but has a shape that is inappropriate for a shadow-mask system.

The conventional shadow-mask panel surface shape is spherical, in which the radius $R_{YO}$ is equal to the radius $R_{XO}$. In large-size tubes, however, most models have a smaller $R_{YO}$.

If the panel surface is flatter, this is advantageous in terms of the ease with which the screen can be viewed.

However, the panel surface has the shape presently in use because of physical limitations and other factors.

When a screen is viewed from the front, the degree of ease with which a picture can be seen is such that there is greater tolerance in the horizontal direction than in the vertical direction, assuming that the panel surface is spherical.

This problem can readily be understood by estimating the degree of ease with which an image or character on the panel can be read assuming a case in which the radius constituting the panel surface is reduced.

When the cylindrical panel of the Trinitron (registered trademark) system and the present shadow-mask panel are compared, it is a fact that the cylindrical panel, in which the radius $R_{YO}$ constituting the surface approximates a straight line, is easier to view, all other problems aside. It is obvious that a shadow-mask panel having a smaller radius $R_{YO}$ has a disadvantageous shape.

The Trinitron (registered trademark) system using the cylindrical panel is advantageous, but a problem is encountered with regard to providing a feeling of satisfaction to the impression of a well-balanced flat panel.

Structurally, the Trinitron (registered trademark) system is such that the panel has a shape obtained by cutting out a portion of a cylinder. Therefore, when it is desired that the degree of ease of convergence by the deflection yoke be made the same as that of a shadow mask, the radius $R_{XO}$ of the panel takes on a value smaller than of the radius $R_{XO}$ of the shadow-mask panel, and the difference between the radius $R_{YO}$ and the radius $R_{XO}$ is great. As a result, it is difficult to obtain the impression of a well-balanced flatness from the panel surface.

In a case where a panel for a Trinitron (registered trademark) having the same ease of convergence as that of the novel panel of this embodiment (described below) is given an outer-surface radius $R_{YO}$ of 30,000 R (in which the units are millimeters) and an inner-surface radius Ryi of 15,000 R, the result of calculations taking the edge of the glass into account as well is that the radius $R_{XO}$ becomes 1,456 R. The ratio of radius $R_{YO}$ to radius $R_{XO}$ is 20.6 to 1. This numerical value gives an impression much different from that of the shape described by the actual dimensions, but even in this design the difference between radius $R_{YO}$ and radius $R_{XO}$ is great and it is difficult to receive an impression of well-balanced flatness.

For comparison purposes in order to investigate this problem, a model was fabricated. The results of calculation are tabulated as shown below. The calculation of the ease of convergence was directed to the inner-surface radius. Since the most difficult direction among the X, Y and D directions is the D direction, the degree of ease of convergence of this cathode-ray tube can be inferred from the numerical value of the result of calculation in the D direction.

With regard to the degree of ease of convergence, an incidence angle, described below, is used (see FIG. 5). Assume that the deflection angle is 106°, and that the effective screen has dimensions of 544 mm in the X direction, 408 mm in the Y direction and 680 mm in the D direction.

Model 1

The radius $R_{XO}$ and other values of a Trinitron (registered trademark) system and shadow-mask system in a case where the angle of incidence $\theta_D$ in the D direction is the same are shown in the table below. X, Y and D indicate the respective directions.

| | INCIDENT ANGLE Θ (°, ', ") | | | PANEL INNER SURFACE RADIUS (mm) | | | PANEL OUTER SURFACE RADIUS (mm) | | |
|---|---|---|---|---|---|---|---|---|---|
| | $\theta_X$ | $\theta_Y$ | $\theta_D$ | $R_{Xi}$ | $R_{Yi}$ | $R_{Di}$ | $R_{XO}$ | $R_{YO}$ | $R_{DO}$ |
| SHADOW-MASK SYSTEM | 37°11' 38" | 30°59' 8" | 43°29' 44" | 1803.22 | 2076.54 | 2060 | 2100 | 3200 | 2430 |
| TRINITRON SYSTEM | 15°24' 6" | 34°59' 45" | 43°29' 44" | 1412.65 | 15000 | 2060 | 1593.67 | 40000 | 2430 |

Model 2

The angle of incidence $\theta_D$ in the D direction and other values in a case where the outer surface and radius $R_{XO}$ of the panel in the X direction are the same in the two systems are shown in the table below.

| | PANEL OUTER SURFACE RADIUS (mm) | | | PANEL INNER SURFACE RADIUS (mm) | | | INCIDENT ANGLE Θ (°, ', ") | | |
|---|---|---|---|---|---|---|---|---|---|
| | $R_{XO}$ | $R_{YO}$ | $R_{DO}$ | $R_{Xi}$ | $R_{Yi}$ | $R_{Di}$ | $\theta_X$ | $\theta_Y$ | $\theta_D$ |
| SHADOW-MASK SYSTEM | 2100 | 3200 | 2430 | 1803.22 | 2076.54 | 2060 | 37°11' 38" | 30°59' 8" | 43°29' 44" |
| TRINITRON SYSTEM | 2100 | 40000 | 3183.22 | 1803.22 | 15000 | 2578.47 | 37°51' 8" | 35°34' 47" | 45°26' 49" |

Model 1 shows that in a case where the angle of incidence $\theta_D$ is the same, namely when the degree of difficulty of convergence is the same, the outer-surface radius R in the X direction, namely $R_{XO}$ is larger in the shadow-mask system. The panel surface is well-balanced owing to the radius in the Y direction.

Model 2 shows that in a case where the outer-surface radius in the X direction is made the same, the angle of incidence in the D direction is larger, and the convergence correction is more difficult, in the Trinitron (registered trademark) system than in the shadow-mask system.

In view of cost as well, it is difficult to find a panel having both viewing ease and a well-balanced surface among the panels presently available.

SUMMARY OF THE INVENTION

Accordingly, an object of the present invention is to provide a panel for a color cathode-ray tube used in a shadow-mask system capable of being applied to high-quality color cathode-ray tube.

According to the present invention, the foregoing object is attained by providing a front panel for a color cathode-ray tube having an internally disposed shadow mask, characterized by having a front panel consisting of a transparent glass material and having an outer surface and an inner surface formed to be curved surfaces, wherein the radius of curvature in one direction of the curved surface forming the outer surface of the front panel is greater than the radius of curvature in a direction perpendicular to the one direction.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Embodiments of the present invention will now be described in detail with reference to the drawings.

In a case where viewing ease is desired to be obtained over the entire surface of the panel of a color cathode-ray tube without the problem of reflected external light from above, it should be obvious from the foregoing discussion that the radius $R_{YO}$ constituting the vertical direction of the panel surface should be made larger than the radius $R_{XO}$ constituting the horizontal direction of the panel surface.

It is difficult to set the ratio of the radius $R_{XO}$ to the radius $R_{YO}$. These should be set individually at the time of panel design for other reasons as well. In general, a suitable selection is a factor of 1.1 or greater, preferably a range of a factor of 1.3 to a factor of about 2.5. In the embodiment described below, a factor of 1.5 and a factor of 1.32 are selected.

Figure 1A:
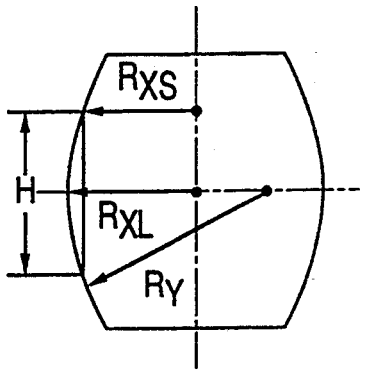
FIG. 1(A) is an elevation of a convex cylindrical shape illustrating the original form of a panel according to the present invention.

A specific basic shape and a development thereof will be described with reference to FIGS. 1(A), 1(B) and FIGS. 2(A), 2(B). As illustrated in FIG. 1(A), the basic shape is such that the central portion is a convex cylinder having a circular arc of radius $R_Y$, with the maximum radius $R_{XL}$ of the cylinder being smaller than the radius $R_Y$.

Figure 1B:
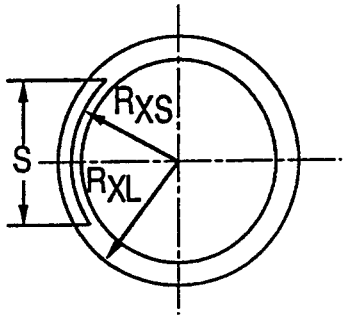
FIG. 1(B) is a plan plan view of the convex cylindrical shape illustrating the original form of a panel according to the present invention.

FIG. 1(B) is a plan view of FIG. 1(A), and radius $R_Y$ represents a right angle to the page.

Figure 2A:
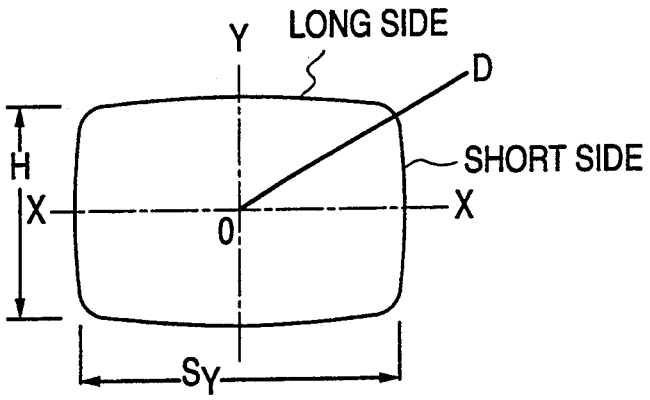
FIG. 2(A) is a front view of the panel and FIG. 2(B) is a sectional view of the panel in X, Y, D directions.

In a case where the configuration of FIGS. 1(A) and 1(B) is applied to a panel, S in FIG. 1(B) corresponds to S in FIG. 2(A), and H in FIG. 1(A) corresponds to H in FIG. 2(A).

Figure 2B:
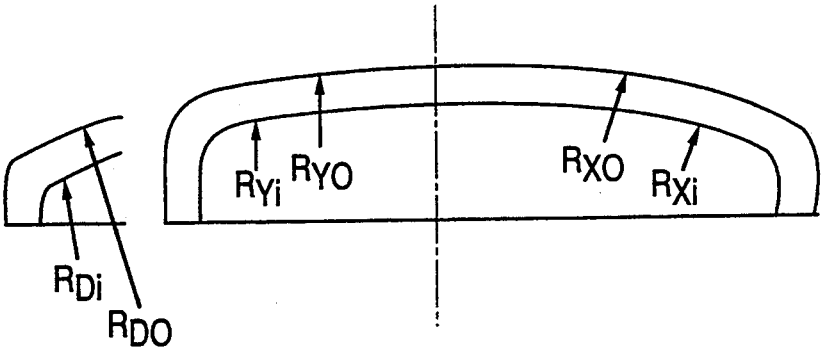

FIG. 2(B) illustrates a cross section in the X, Y and D directions of FIG. 2(A), $R_{XO}$, $R_{YO}$, $R_{DO}$ denote outer-surface radii, and $R_{XI}$, $R_{YI}$, $R_{DI}$ represent inner-surface radii.

In FIG. 1(A), radius $R_Y$ corresponds to radius $R_{YO}$ in FIG. 2(B), and radius $R_{XL}$ in FIG. 1(A) corresponds to radius $R_{XO}$ in FIG. 2(B).

In FIG. 2(B), radius $R_{DO}$ is a radius R in the D direction of the surface formed by the radius R, which is based upon radii $R_{XO}$ and $R_{YO}$. Even if radii $R_{XO}$. $R_{YO}$ are each a simple radius R, the radius $R_{YO}$ is larger than the ratio $R_{XO}$ and therefore is not a simple radius R.

In FIG. 1(A), radius $R_{XS}$ represents the a radius R of the outer surface of the panel in the X direction at the edges of the long sides in FIG. 2(A). When the invention is practiced, this numerical value is not simply used by taking other factors into consideration.

A panel surface constituted by the foregoing means is flatter in the Y direction in comparison with the conventional shadow-mask panel, and appropriate values of radii $R_{XI}$, $R_{YI}R_{DI}$ are selected upon taking other factors such as convergence into consideration. As a result, there is provided a novel panel having an easy-to-view and well-balanced flat surface different from the conventional panel for shadow masking.

Embodiments will now be described in which the present invention is applied to a 29-inch tube and a 36-inch HD tube (high-definition cathode-ray tube).

At first, the case of a 29-inch tube will be described.

The deflection angle of the 29-inch tube is 106°, and the neck diameter is 29.1 (mm) $\phi$.

Figure 3A:
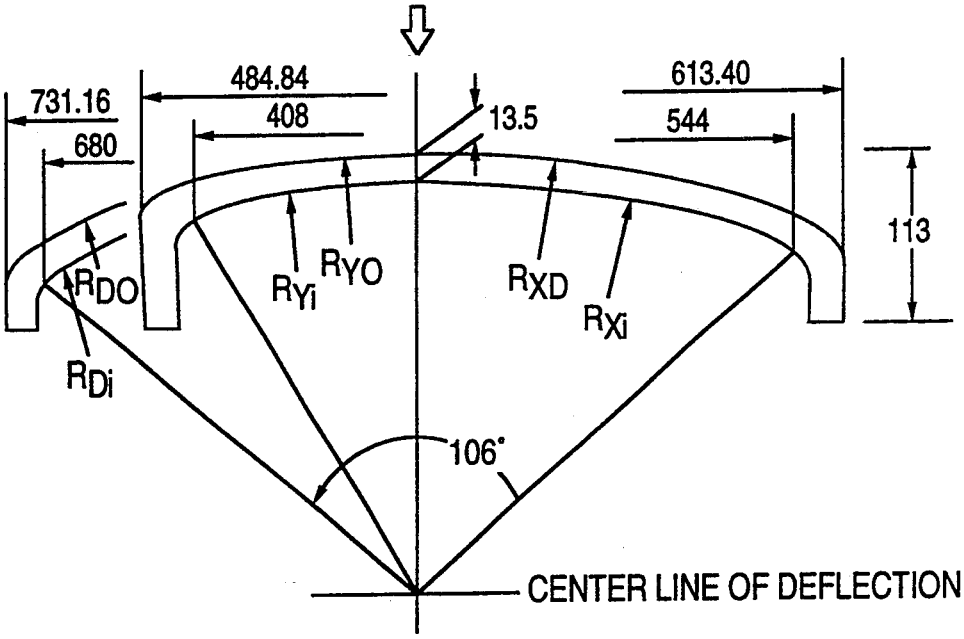
FIG. 3(A) is a sectional view of the panel showing the dimensions of a 29-inch panel embodying the present invention.
Figure 3B:
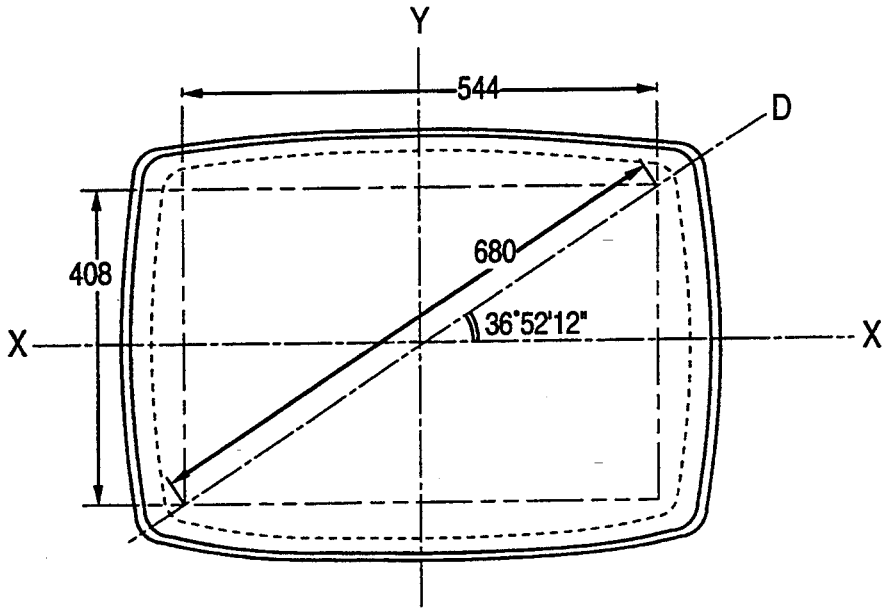
FIG. 3(B) is a plan view of the same.

FIG. 3(A) is a sectional view of the panel along X, Y, D axes, and FIG. 3B is a plan view as seen from the direction of the arrow in FIG. 3(A). The two-dot chain line in FIG. 3(B) represents the effective screen.

In general, as a simple method of representing the size of the radius R of the panel surface, a numerical value which is 40 times the inch size of the panel is adopted as a 1 r unit, and the size of a panel-surface radius corresponding to the panel size will be discussed using a multiple of this numerical value.

For example, in case of a 29-inch cathode-ray tube, the value is $29\times40=1160$.

The value 1160 is a 1 r unit in case of a 29-inch cathode-ray tube, and numerical values within parentheses following the outer-surface radius and inner-surface radius correspond thereto.

When the radii R of the inner and outer surfaces of the panel are expressed by a simple radius for the sake of convenience, we have the following:

Outer-surface radius:

$R_{XO}$=2000 R (1.72 r)

$R_{YO}$=3000 R (2.59 r)

$R_{DO}$=2350 R (2.03 r)

Inner-surface radius:

$R_{Xi}$=1730 R (1.49 r)

$R_{Yi}$=1990 R (1.72 r)

$R_{Di}$=2000 R (1.72 r)

The effective screen is 544 mm(X direction), 408(Y direction), 680 mm (D direction).

In actuality, the radii $R_{XO}$, $R_{Xi}$ are not simple radii but are curves defined by a polynomial. $R_{XO}$=2367 R (2.04 r) holds in the vicinity of the center of the screen, and $R_{XO}$=1750 (1.51 r) holds in the vicinity of the edge of the screen along the X axis.

With regard to the radius $R_{Xi}$ also, 2041 R(1.76 r) and 970 R(0.84 r) hold in the vicinity of the center and edges. The radius $R_{XO}$ is a similar curve based upon the radius $R_{Xi}$.

The radius $R_{YO}$ at the center of the screen is 3000 R (2.59 r), and the radius $R_{YO}$, which is parallel to the Y axis, at the X-axis edge of the screen is 3390.08 R(2.92 r).

As for the constitution of the screen, the X-axis direction is constituted by a curve based upon similar polynomials of radii $R_{XO}$, $R_{Xi}$, and the Y-axis direction is constituted by a simple radius, taking image distortion into consideration.

With regard to the radii $R_{XO}$, $R_{Xi}$ also, a large change in the size of the curves is avoided, and a curve approximating a simple radius, which will reduce image distortion, is adopted while taking convergence into consideration.

Secondly, the case of a 36-inch HD tube will now be described.

The deflection angle is 106°, and the neck diameter is 32.5(mm) $\phi$ and 34(mm) $\phi$.

Figure 4A:
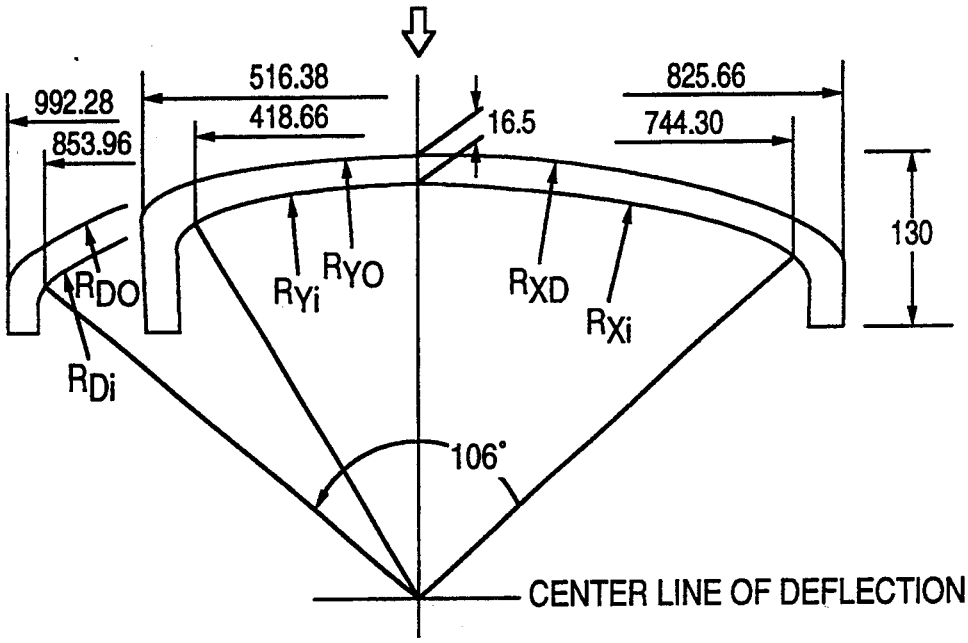
FIG. 4(A) is a sectional view showing panel dimensions for an embodiment in which the present invention is applied to a 36-inch high-resolution TV cathode-ray tube.
Figure 4B:
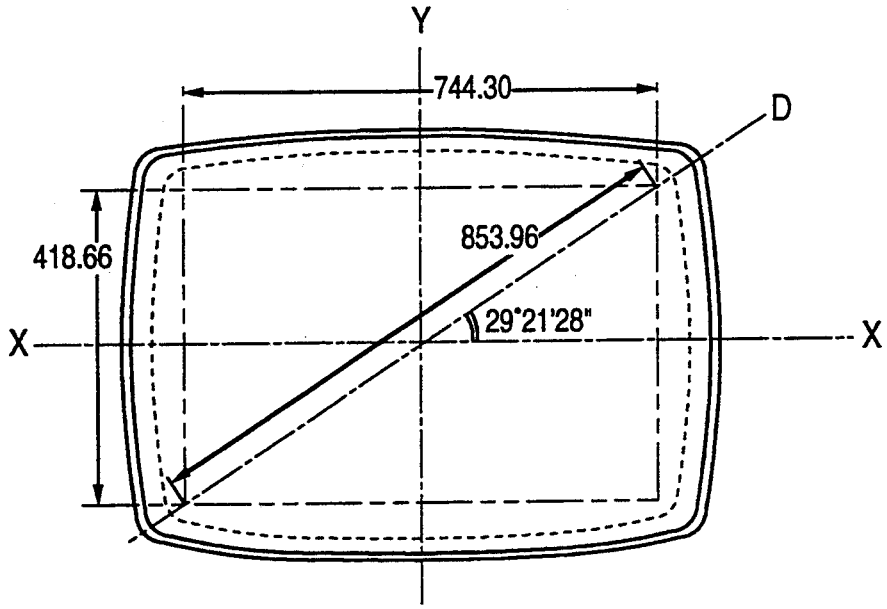
FIG. 4(B) is a plan view of the same.

FIG. 4(A) is a sectional view of the panel along X, Y, D axes, and FIG. 4B is a plan view as seen from the direction of the arrow in FIG. 4(A). The two-dot chain line in FIG. 4(B) represents the effective screen.

In case of a 29-inch HD panel, the value is $36\times40=1440$.

The value 1440 is the unit of radius 1 R in case of a 36-inch panel, and numerical values within parentheses following the outer-surface radoius and inner-surface radius correspond thereto.

Unlike the case of the 29-inch panel, the radii of the inner and outer surfaces in the X-axis direction are constituted by a simple radius. The Y-axis direction is constituted by a simple radius. The inner-and outer-surface radii of the panel are as follows:

Outer-surface radius:

$R_{XO}$=2800 R (1.94 r)

$R_{YO}$=3700 R (2.57 r)

$R_{DO}$=3000 R (2.08 r)

Inner-surface radius:

$R_{Xi}$=2510 R (1.74 r)

$R_{Yi}$=2380 R (1.65 r)

$R_{Di}$=2650 R (1.84 r)

The longitudinal/transverse ratio of the effective screen is 16:9. We then have the following:

X direction: 744.30 mm

Y direction: 418.66 mm

D direction: 853.96 mm

Even if radius $R_x$ in the X direction and radius $R_Y$ in the Y direction are simple radii, radius $R_Y$ has a value larger than that of radius $R_X$, and therefore radius $R_D$ in the D direction is a polynomial curve and not a simple radius.

Radius $R_{YO}$ at the center of the screen is 3700 R, and radius $R_{YD}$, which is parallel to the Y axis, at the X-axis edge of the screen is 3831.70 R.

Radius $R_{XO}$ at the center of the screen is 2800 R, and radius R, which is parallel to the X axis, at the Y-axis edge of the screen is 2822.91 R.

The D-direction $R_{DO}$ is a polynomial curve. When this is represented by a simple radius for the sake of convenience, we have 3000 R (2.08 r).

In order to determine the ease of convergence by a deflection yoke, the angle of incidence at the D edge was investigated. It was confirmed that problems arise with regard to convergence (CFD,PFD) at an angle of 43° 11'34".

CFD refers to a convergence-free DY deflection yoke. This is a DY in which correction of convergence and correction of up-down pin-cushion distortion can be carried out.

PFD is a DY in which correction of left-right pin-cushion distortion also can be corrected.

Besides CFD and PFD, there are NONE CFDs (a DY for applying dynamic convergence). Among the NONE CFDs, there is also a digital-convergence DY (used in some high-definition TVs) in which a precise correction is carried out. However, use of a NONE CFD-type DY is a factor in higher cost of a color cathode-ray tube.

Figure 5:
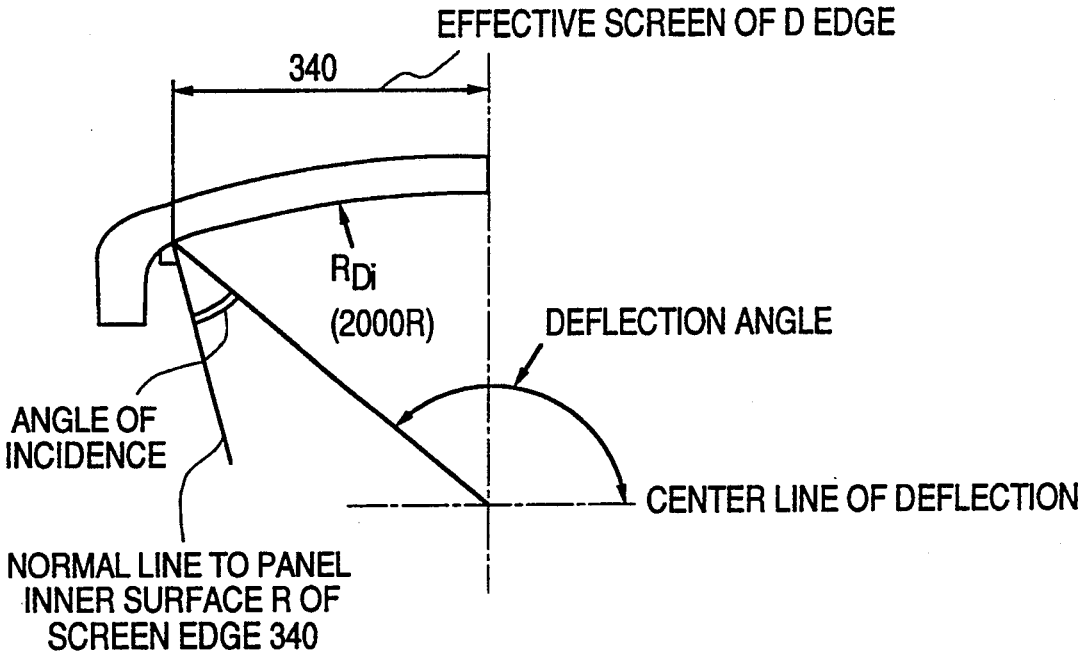
FIG. 5 is a view for describing an angle of incidence in the cross section of the D end of a panel, in which some dimensions of a 29-inch panel embodiment the present invention are shown.
Figure 6A:
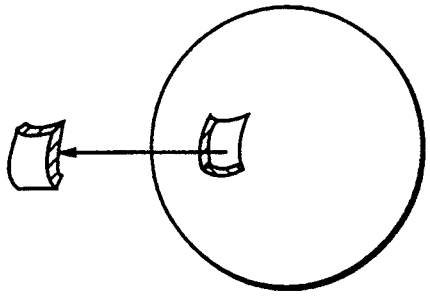
FIG. 6(A) is a view of a sphere showing the original form of a shadow-mask panel according to the prior art.
Figure 6B:
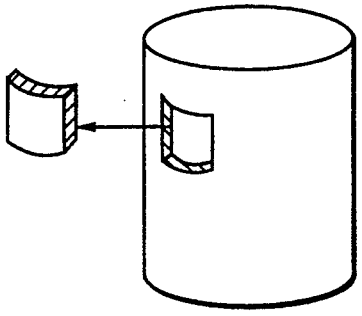
FIG. 6(B) is a view of a cylinder showing the original form of a cylindrical-type panel according to the prior art.

The angle of incidene refers to an angle defined by a line connecting the edge of the effective screen of the inner panel surface and the center of deflection and a line normal to the inner-surface radius of the panel at this edge of the screen(see FIG. 5).

The angle of incidence of the D edge has a value greater than of the angle of incidence of the Y edge. By determining the angle of incidence of the D edge, the ease of convergence by the cathode-ray tube can be ascertained.

In a case where the angle of incidence is large, convergence becomes difficult; convergence is facilitated by using a smaller angle. The limit of the angle of incidence cannot be decided. However, if 44° or the vicinity thereof is exceeded, convergence becomes difficult from past embodiments in case of PFD, CFD.

Based upon the numerical values of the foregoing embodiments, the novel shadow-mask panel of the invention has a radius $R_{YO}$ of a large value not seen in the conventional shadow-mask panels, and the surface thereof is flat and easy to view, especially since there is no problem relating to reflection of outside light from above. In addition, from the numerical values of the radius $R_{XO}$, it should be obvious that the screen is flat in the left-right direction as well.

The overall panel surface exhibits little image distortion, is easy to view and well-balanced. Thus there can be provided a shadow-mask panel capable of accommodating high-quality color cathode-ray tubes for which there will be greater demand in the future.

By using the panel of the present invention in combination with a shadow mask employing non-deforming steel having a small coefficient of expansion, the advantages of this novel panel can be manifested to an even greater extent.

As many apparently widely different embodiments of the present invention can be made without departing from the spirit and acope thereof, it is to be understood that the invention is not limited to the specific embodiments thereof except as defined in the appended claims.

What is claimed is:

1. A front panel for a color cathode-ray tube having an X-axis, a Y-axis and an internally disposed shadow mask, said front panel consisting of a transparent glass material and having an outer surface and an inner surface formed to be curved surfaces with a radius of curvature along the Y-axis of the curved surface forming the outer surface of said front panel greater than the radius of curvature along the X-axis.

2. An apparatus included in a cathode-ray tube comprising:

a front panel of the cathode-ray tube, having an outer surface with a first radius of curvature in a vertical direction of the cathode-ray tube, greater than a second radius of curvature in a horizontal direction of the cathode-ray tube.

3. An apparatus included in a cathode-ray tube, comprising:

a front panel of the cathode-ray tube, having an outer surface with a first radius of curvature along a minor axis of the cathode-ray tube, greater than a second radius of curvature along a major axis of the cathode-ray tube.

* * * * *